US007571782B2

(12) United States Patent
Hall et al.

(10) Patent No.: US 7,571,782 B2
(45) Date of Patent: Aug. 11, 2009

(54) STIFFENED BLADE FOR SHEAR-TYPE DRILL BIT

(76) Inventors: David R. Hall, 2185 S. Larsen Pkwy., Provo, UT (US) 84606; John Bailey, 2185 S. Larsen Pkwy., Provo, UT (US) 84606

( * ) Notice: Subject to any disclaimer, the term of this patent is extended or adjusted under 35 U.S.C. 154(b) by 0 days.

(21) Appl. No.: 11/767,044

(22) Filed: Jun. 22, 2007

(65) Prior Publication Data

US 2008/0314645 A1 Dec. 25, 2008

(51) Int. Cl.
*E21B 10/36* (2006.01)

(52) U.S. Cl. ..... 175/432; 175/425

(58) Field of Classification Search ..... 175/425, 175/426, 432, 374
See application file for complete search history.

(56) References Cited

U.S. PATENT DOCUMENTS

| | | | | |
|---|---|---|---|---|
| 4,109,737 | A | 8/1978 | Bovenkerk | |
| 4,499,958 | A * | 2/1985 | Radtke et al. | 175/428 |
| 5,101,692 | A | 4/1992 | Simpson | |
| 5,333,699 | A | 8/1994 | Thigpen et al. | |
| 5,435,403 | A | 7/1995 | Tibbitts | |
| 5,441,121 | A | 8/1995 | Tibbitts | |
| 5,449,048 | A | 9/1995 | Thigpen | |
| 5,558,170 | A | 9/1996 | Thigpen | |
| 5,560,440 | A | 10/1996 | Tibbitts | |
| 5,848,657 | A | 12/1998 | Flood | |
| 6,021,859 | A | 2/2000 | Tibbitts | |
| 6,302,224 | B1 | 10/2001 | Sherwood | |
| 6,332,503 | B1 | 12/2001 | Pessier | |
| 6,408,958 | B1 | 6/2002 | Isbell et al. | |
| 6,408,959 | B2 | 6/2002 | Bertagnolli | |
| 6,484,826 | B1 | 11/2002 | Anderson | |
| 6,651,756 | B1 | 11/2003 | Costo et al. | |
| 6,672,406 | B2 | 1/2004 | Beuershausen | |
| 7,070,011 | B2 | 7/2006 | Sherwood | |
| 7,216,565 | B2 | 5/2007 | Sherwood | |
| 2001/0004946 | A1 * | 6/2001 | Jensen | 175/428 |
| 2005/0103533 | A1 * | 5/2005 | Sherwood et al. | 175/432 |
| 2007/0251732 | A1 * | 11/2007 | Mirchandani et al. | 175/393 |

* cited by examiner

*Primary Examiner*—Jennifer H Gay
*Assistant Examiner*—Elizabeth C Gottlieb
(74) *Attorney, Agent, or Firm*—Tyson J. Wilde; Jad A. Mills

(57) ABSTRACT

In one aspect of the invention, a drill bit comprises a steel body disposed intermediate a threaded end and a working face. The steel body comprises a plurality of steel blades disposed along an outer diameter of the body and extending radially away from an axis of rotation of the bit. A plurality of cutter elements is disposed on the plurality of steel blades and the blades each comprise a steel stiffness and a steel elastic modulus. At least one of the plurality of steel blades comprises a stiffening element and an overall stiffness at least 3.5 times greater than the steel stiffness.

10 Claims, 9 Drawing Sheets

STIFFENED BLADE FOR SHEAR-TYPE DRILL BIT

BACKGROUND OF THE INVENTION

This invention relates to drill bits, specifically drill bit assemblies for use in oil, gas and geothermal drilling. Often drill bits are subjected to harsh conditions when drilling below the earth's surface. Replacing damaged drill bits in the field is often costly and time consuming since the entire downhole tool string must typically be removed from the borehole before the drill bit can be reached. Bit balling in soft formations and bit whirl in hard formations may reduce penetration rates and may result in damage to the drill bit. Further, loading too much weight on the drill bit when drilling through a hard formation may exceed the bit's capabilities and also result in damage. Too often unexpected hard formations are encountered suddenly and damage to the drill bit occurs before the weight on the drill bit may be adjusted. In addition, factors such as formation hardness, bit load and bit composition may impact the rate of penetration (ROP) of the drill bit into the formation. The prior art discloses shear bits with steel or carbide matrix blades.

U.S. Pat. No. 5,947,215, which is herein incorporated by reference for all that it contains, discloses a rock drill bit for percussive drilling including a steel body in which six gauge buttons and a single front button are mounted. The gauge buttons are arranged symmetrically and equally spaced about a central axis of the bit. The front button is arranged along the central axis. The front button is of larger diameter than the gauge buttons are diamond-enhanced, and the front button may be diamond enhanced.

U.S. Pat. No. 7,070,011 to Sherwood, Jr. et al., which is herein incorporated by reference for all that it contains, discloses a steel body rotary drag bit for drilling a subterranean formation that includes a plurality of support elements affixed to the bit body, each forming at least a portion of a cutting element pocket.

U.S. Pat. No. 5,333,699 to Thigpen et al., which is herein incorporated by reference for all that it contains, discloses a drill bit having polycrystalline diamond compact cutter with spherical first end opposite cutting end.

BRIEF SUMMARY OF THE INVENTION

In one aspect of the invention, a drill bit comprises a steel body disposed intermediate a threaded end and a working face. The steel body comprises a plurality of steel blades disposed along an outer diameter of the body and extending radially away from an axis of rotation of the bit. A plurality of cutter elements is disposed on the plurality of steel blades and the blades each comprise a steel stiffness and a steel elastic modulus. At least one of the plurality of steel blades comprises a stiffening element and an overall stiffness at least 3.5 times greater than the steel stiffness. In some embodiments of the invention at least one blade may comprise an overall stiffness at least 5 times greater than the steel stiffness. The steel elastic modulus may comprises at least 25 million pounds per square inch.

The stiffening element may be disposed on the at least one blade on a gauge portion, flank portion, nose portion, cone portion, or combinations thereof. The stiffening element may comprise a cemented metal carbide. It may be disposed on at least one blade's back surface that is opposite one of the plurality of cutter elements. The stiffening element may be a generally cylindrical metal carbide segment that is disposed behind and substantially coaxial with at least one of the cutter elements. A plurality of generally cylindrical metal carbide segments may be disposed along substantially an entire length of the at least one blade.

The stiffening element may be a backing plate, a bracket, a carbide segment, a carbide rod, or combinations thereof. The stiffening element may be disposed intermediate at least one of the cutter elements and the at least one blade. At least one of the cutter elements may be attached to the at least one blade by the stiffening element. The stiffening element may comprise an elastic modulus of at least 100 million pounds per square inch.

At least one of the cutter elements may comprise a superhard material disposed on a cutting surface. At least one of the plurality of cutter elements may be brazed to the stiffening element. The stiffening element may be brazed to the blade. At least one of the plurality of steel blades may comprise a plurality of stiffening elements.

In another aspect of the invention, a drill bit comprises a steel body disposed intermediate a threaded end and a working face. The steel body comprises a plurality of steel blades disposed along an outer diameter of the body and extending radially away from an axis of rotation of the bit. A plurality of cutter elements is disposed on the plurality of steel blades. At least a portion of at least one blade comprises a plurality of materials creating an overall composite elastic modulus of at least 100 million pounds per square inch.

DETAILED DESCRIPTION OF THE INVENTION AND THE PREFERRED EMBODIMENT

Figure 1:
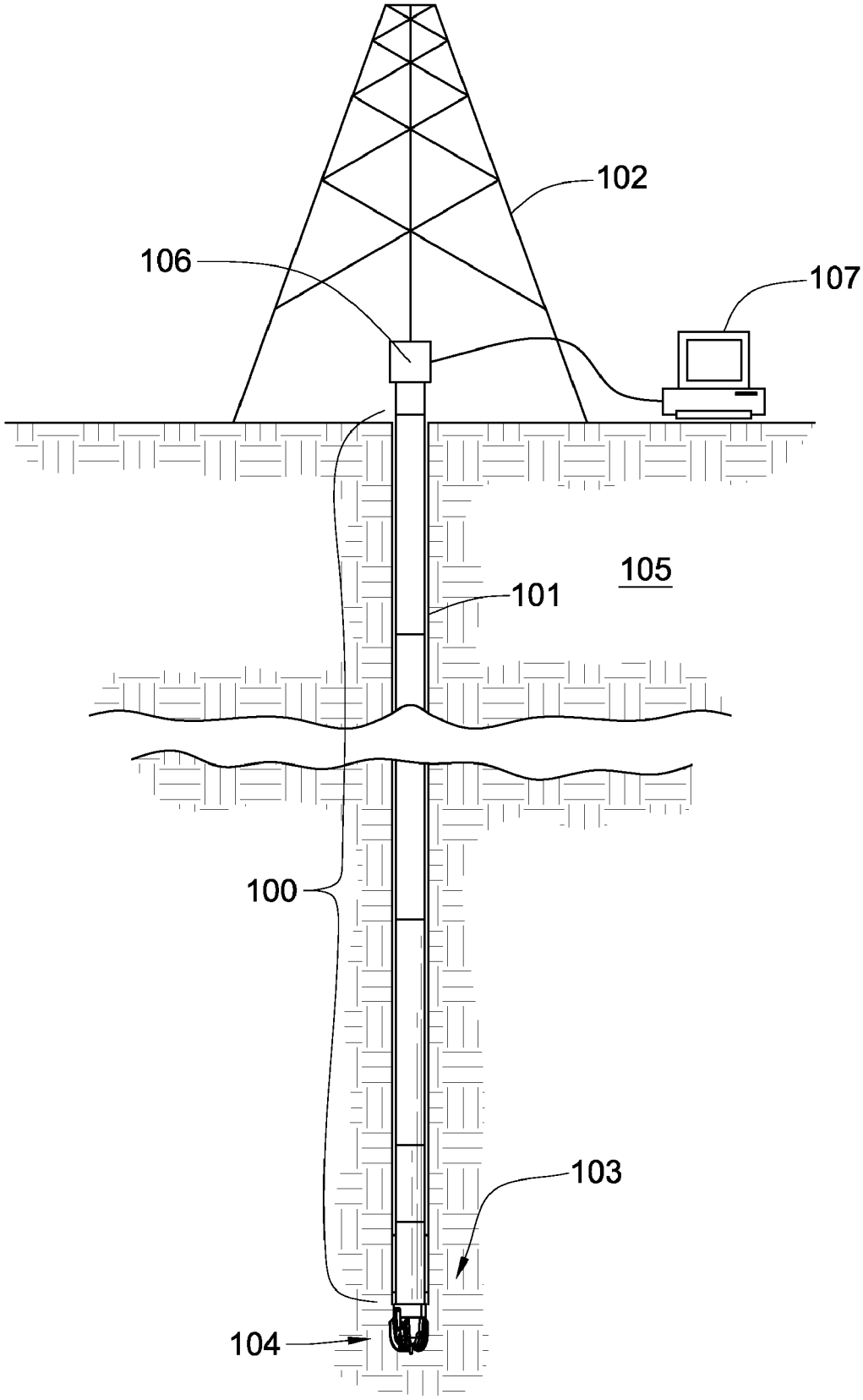
FIG. 1 is a cross-sectional diagram of an embodiment of a drill string suspended in a bore hole.

FIG. 1 is a cross-sectional diagram of an embodiment of a drill string 100 suspended in a borehole 101 by a derrick 102. A bottom-hole assembly 103 is located at the bottom of the borehole 101 and comprises a drill bit 104. As the drill bit 104 rotates downhole the drill string 100 advances farther into the earth. The drill string 100 may penetrate soft or hard subterranean formations 105. The bottom-hole assembly 103 and/or downhole components may comprise data acquisition devices which may gather data. The data may be sent to the surface via a transmission system to a data swivel 106. The data swivel 106 may send the data to surface equipment 107. Further, the surface equipment may send data and/or power to downhole tools and/or the bottom-hole assembly 103. U.S. Pat. No. 6,670,880 which is herein incorporated by reference for all that it contains, discloses a telemetry system that may be compatible with the present invention; however, other forms of telemetry may also be compatible such as systems that include mud pulse systems, electromagnetic waves, radio waves, and/or short hop. In some embodiments, no telemetry system is incorporated into the drill string. Mud pulse, short hop, or EM telemetry systems may also be used with the present invention.

Figure 2:
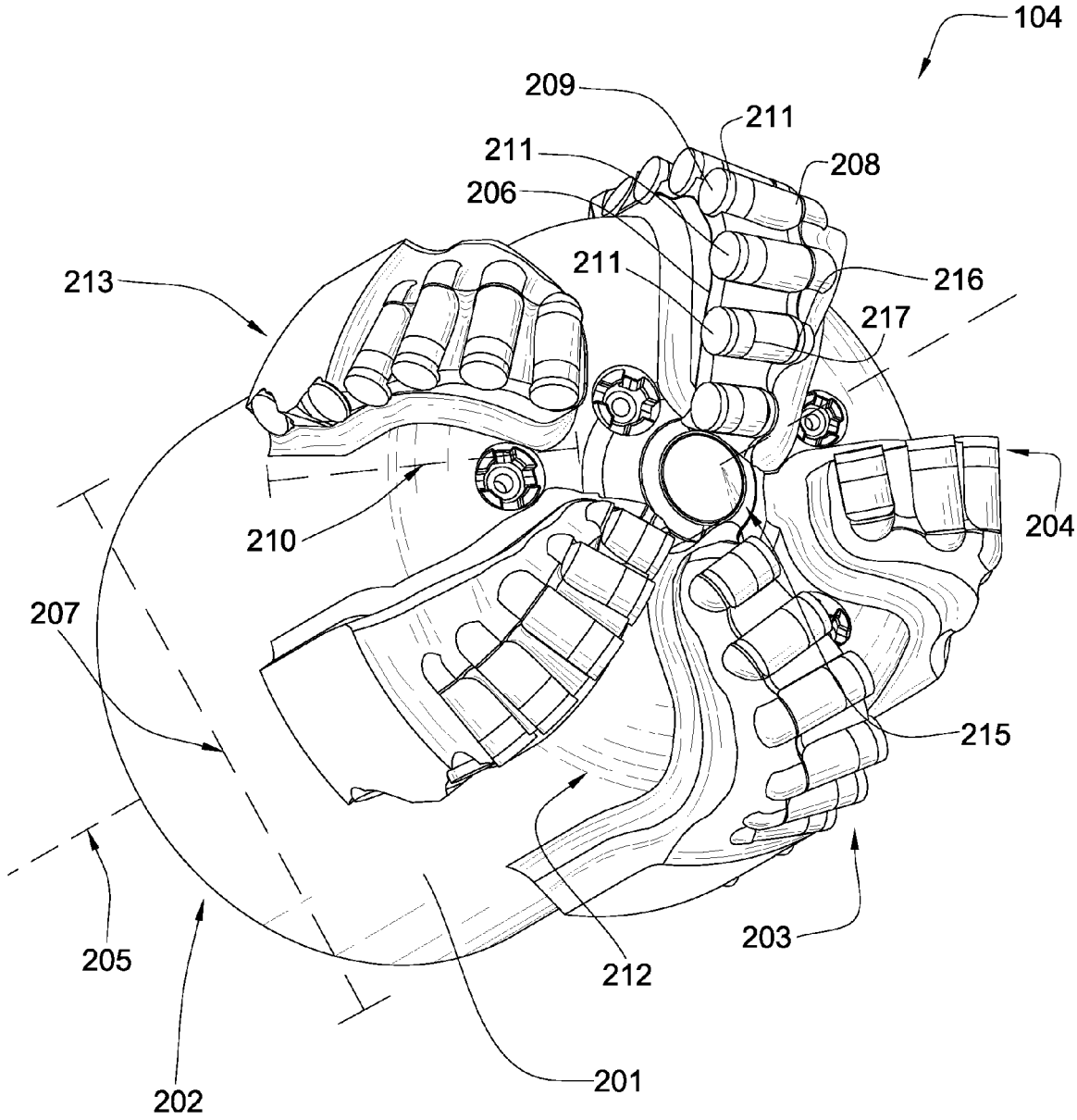
FIG. 2 is a perspective diagram of an embodiment of a drill bit.

Referring to FIG. 2, the drill bit 104 may be a shear bit. The bit 104 comprises a steel body 201 disposed intermediate a threaded end 202 and a working face 203. A plurality of fixed cutter elements 204 is disposed on the working face 203. These cutter elements 204 degrade the formation when the bit rotates around an axis of rotation 205. The cutter elements 204 may be 13 to 19 mm in diameter. The bit 104 comprises a plurality of steel blades 206 disposed along an outer diameter 207 of the body 201 and extending radially away from the axis of rotation 205. At least some of the plurality of cutter elements 204 are disposed on the blades 206. Each of the plurality of steel blades 206 comprises a steel stiffness and a steel elastic modulus. In some embodiments of the invention the steel elastic modulus may be at least 25 million pounds per square inch. The steel elastic modulus may be between 27 and 33 million pounds per square inch. The steel stiffness may be determined by the elastic modulus of the steel and by the shape of the steel. At least one of the plurality of steel blades 206 comprises at least one stiffening element 208. In some embodiments of the invention a stiffening element 208 may comprise an elastic modulus of at least 100 million pounds per square inch. The blade 206 comprising a stiffening element 208 also comprises an overall stiffness at least 3.5 times greater than the steel stiffness. In some embodiments of the invention the blade 206 may comprise an overall stiffness at least 5 times greater than the steel stiffness. It is believed that the greater stiffness of the steel blade 206 may optimize the impact impulse generated by cutter elements 204 on the formation when the cutter elements 204 contact the formation. This may optimize the rate of penetration (ROP) of the drill bit 104, while minimizing the cost of the blade 206. Optimized impact impulse may also reduce wear on the cutter elements 204 or on the bit 104.

In the embodiment of FIG. 2, the working face 203 comprises five blades 206, though the working face 203 may comprise any number of blades 206. Each blade comprises a plurality of cutter elements 204. The cutter elements 204 each comprise a cutting surface 209 and may be arrayed along substantially an entire length 210 of a blade 206. The cutting surface 209 of the cutter elements 204 preferably comprises a superhard material 211 with a hardness of at least 63 HRc. The superhard material 211 may comprise diamond, polycrystalline diamond, cubic boron nitride, cobalt, or combinations thereof. In FIG. 2, each blade 206 comprises a plurality of stiffening elements 208. The stiffening elements 208 may comprise tungsten carbide, other types of cemented metal carbides, or combinations thereof. A stiffening element 208 may be a backing plate, a bracket, a carbide segment, a carbide rod, or combinations thereof. In some embodiments the bit 104 may comprise a variety of types of stiffening elements 208. In the embodiment of FIG. 2 stiffening elements 208 are metal carbide segments 216 and each segment 216 comprises a generally cylindrical geometry. The segments 216 in the embodiment of FIG. 2 are each disposed behind and substantially coaxial with at least one cutter element 204. Segments 216 may be disposed along substantially the entire length 210 of a blade 206. A segment 216 may be brazed together with a cutter element 204 with a high-strength braze 217. The cutter element 204 and the segment 216 may then be brazed to the blade 206. In some embodiments of the invention only the stiffening element 208 may be brazed to the blade 206. Brazing the cutter element 204 to a segment 216 may allow for cutter elements 204 to be more shallowly imbedded into the blade 206 than may be common in the art without decreasing the surface area of the blade 206 that is connected to the cutter element 204 directly or indirectly by a braze. In FIG. 2 the blades 206 form a plurality of junk slots 212 which converge proximate the axis of rotation 205 on the working face 203 and diverge radially towards a gauge 213 of the bit 104.

A jack element 215 coaxial with the axis of rotation 205 of the bit 104 may be disposed within and extend from the working face 203. The shape of the working face 203 and the arrangement of the cutter elements 204 may be such that as the bit rotates, a raised portion is formed in the formation 105 by a conical portion of the blades. The jack element 215 compresses the center of the raised portion, creating an indention. The indention may help stabilize the drill bit 104 and may reduce bit whirl by maintaining the jack element 215 centered about the indention.

The jack element 215 may be a hard, metal insert which may be brazed or press fit into a recess in the working face 203. The hard metal may comprise a tungsten carbide, niobium carbide, a cemented metal carbide, hardened steel, titanium, tungsten, aluminum, chromium, nickel, or combinations thereof. The jack element 215 may comprise a surface comprising a hard material with a hardness of at least 63 HRc, which may lengthen the lifetime of the jack element 215 and may aid in compressing harder formations. The hard material may comprise a polycrystalline diamond, natural diamond, synthetic diamond, vapor deposited diamond, silicon bonded diamond, cobalt bonded diamond, thermally stable diamond, polycrystalline diamond with a binder concentration of 1 to 40 weight percent, infiltrated diamond, layered diamond, polished diamond, course diamond, fine diamond, cubic boron nitride, chromium, titanium, matrix, diamond impregnated matrix, diamond impregnated carbide, a cemented metal carbide, tungsten carbide, niobium, or combinations thereof. In some embodiments of the invention the jack element 215 may oscillate.

Figure 3:
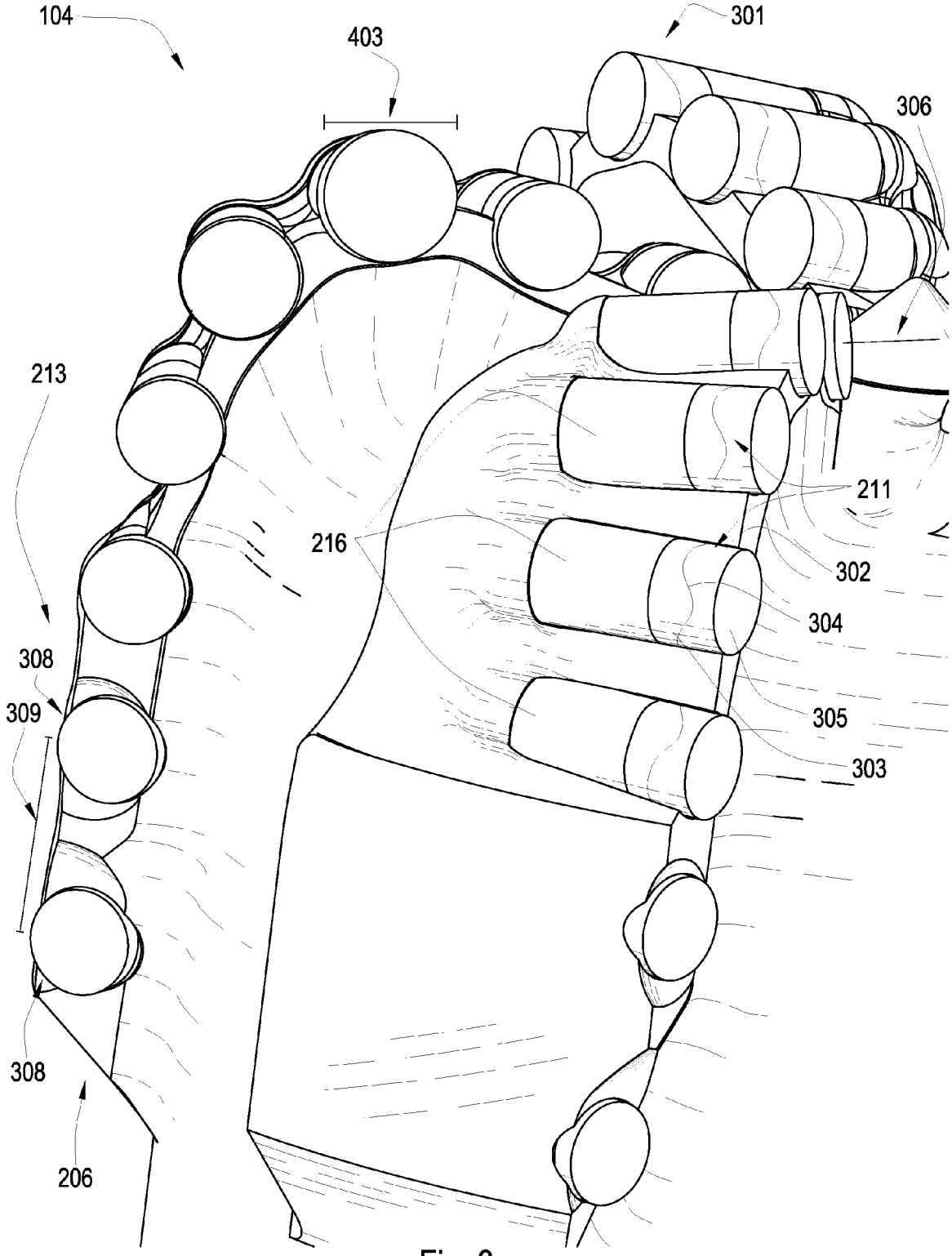
FIG. 3 is a perspective diagram of another embodiment of a drill bit.

Referring now to FIG. 3, one or more cutter elements 204 may be like those disclosed in U.S. patent application Ser. No. 11/734,675 by Hall et al., which is herein incorporated by reference for all that it contains. The cutter element 301 comprises a sintered body 302 of diamond or diamond-like particles in a metal matrix bonded to a cemented metal carbide substrate 303 at a non-planar interface 304. The sintered body 302 comprises a flat working surface 305. At least one region of the working surface 305 may be far enough away from the non-planar interface 304 that during high pressure, high temperature (HPHT) processing a restricted amount of metal from the substrate reaches the region, the amount comprising 5 to 0.1 percent of the region by volume, resulting in the region comprising a high density of superhard particles. The region may comprise the characteristic of being able to withstand an impact of at least 80 joules, and in some embodiments more than 120 joules according to the testing parameters described in U.S. patent application Ser. No. 11/766,975. Also, due to the low metal concentration in the region, the region may be substantially non-electrically conductive. The diamond in the sintered body 302 may comprise an average particle size of 5 to 60 microns.

FIG. 3 also discloses cutter elements 204 placed on the blade 206 with varying densities at different positions of the blade 206. Adjacent cutter elements 308 comprise an intermediate distance 309. The intermediate distance 309 between adjacent cutter elements 308 may vary at different positions along the blade 206. In the present embodiment adjacent cutter elements 308 disposed on the gauge 213 of the bit 104 have a longer intermediate distance 309 than adjacent cutter elements 308 that are disposed near a nose portion 403 of the blade 206. In some embodiments of the invention cutter elements 204 may each comprise a central axis 306. Adjacent cutter elements 308 may be coaxial. In some embodiments of the invention central axes 306 of adjacent cutter elements 308 may be perpendicular or may intersect at an acute or obtuse angle.

Figure 4:
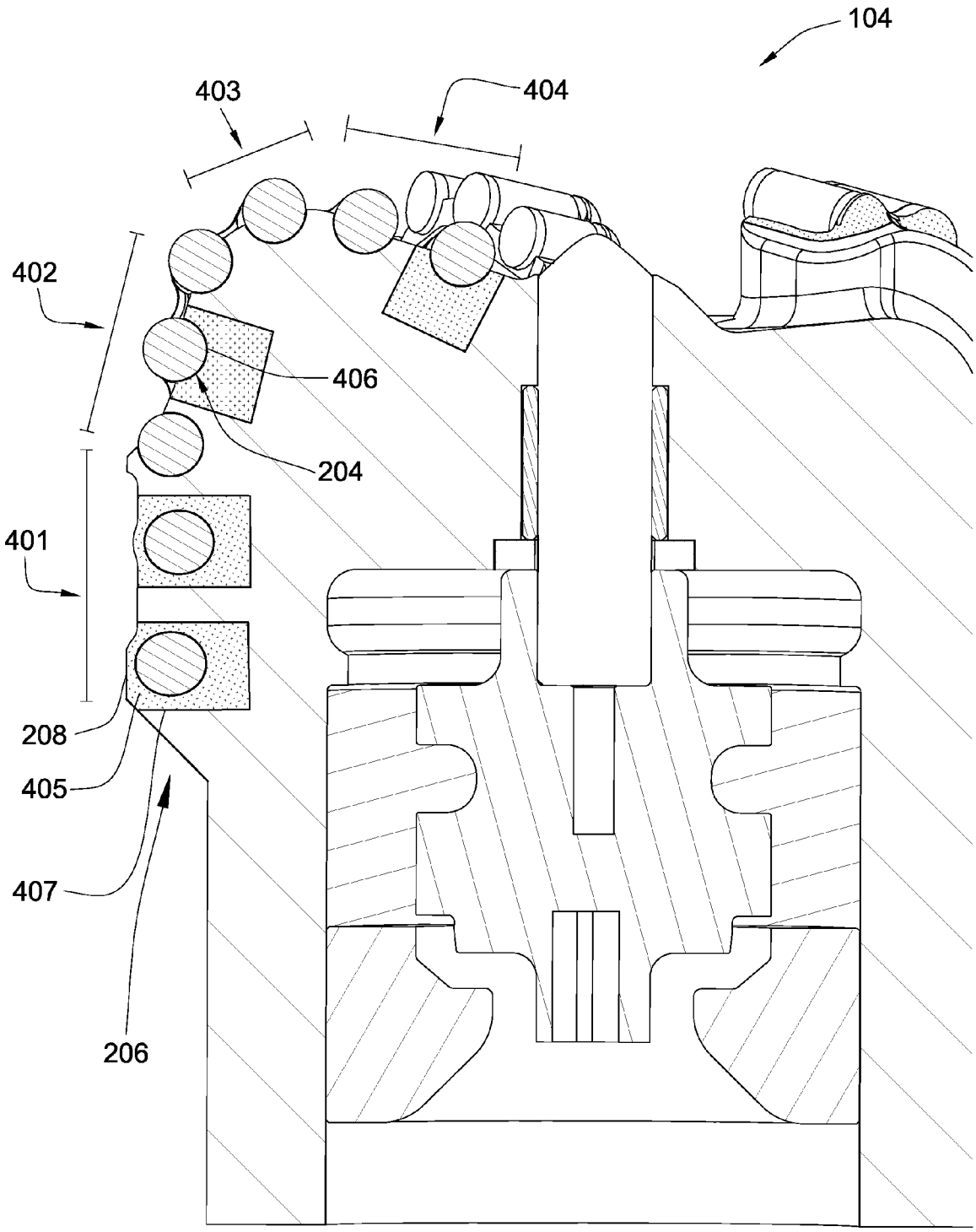
FIG. 4 is a cross-sectional diagram of another embodiment of a drill bit.

Referring now to FIG. 4, blade 206 comprises a gauge portion 401, a flank portion 402, a nose portion 403, and a cone portion 404. Stiffening elements 208 may be disposed on the gauge portion, flank portion, nose portion, cone portion, or on combinations thereof. In some embodiments of the invention all portions 401, 402, 403, 404 of the blade 206 may comprise stiffening elements 208. FIG. 4 also discloses a stiffening element 208 that is a carbide insert 405. Carbide inserts 405 may be press fit into a cavity 407 in the steel blade 206. Carbide inserts 405 may comprise an outer rounded surface 406 complementary for mating with a generally cylindrical cutter element 204. A cutter element 204 may be brazed to the rounded surface 406 of a carbide insert 405. The cutter element 204 may also be brazed to the steel blade 206.

Blades 206 may comprise a plurality of materials that create an overall composite elastic modulus of at least 100 million pounds per square inch. For instance, the blade may comprise a steel elastic modulus of approximately 29 million pounds per square inch. Stiffening elements 208 may comprise an elastic modulus much greater than that. By press fitting carbide inserts 405 into the blade 206, the overall elastic modulus of the blade may increase to at least 100 million pounds per square inch. In some embodiments of the invention the overall elastic modulus of the blade 206 may be larger than a proportional sum of both the steel elastic modulus and the elastic modulus of the carbide inserts 405. In some embodiments of the invention only one portion 401, 402, 403, 404 of the blade 206 may comprise an overall composite elastic modulus of at least 100 million pounds per square inch.

Figure 5:
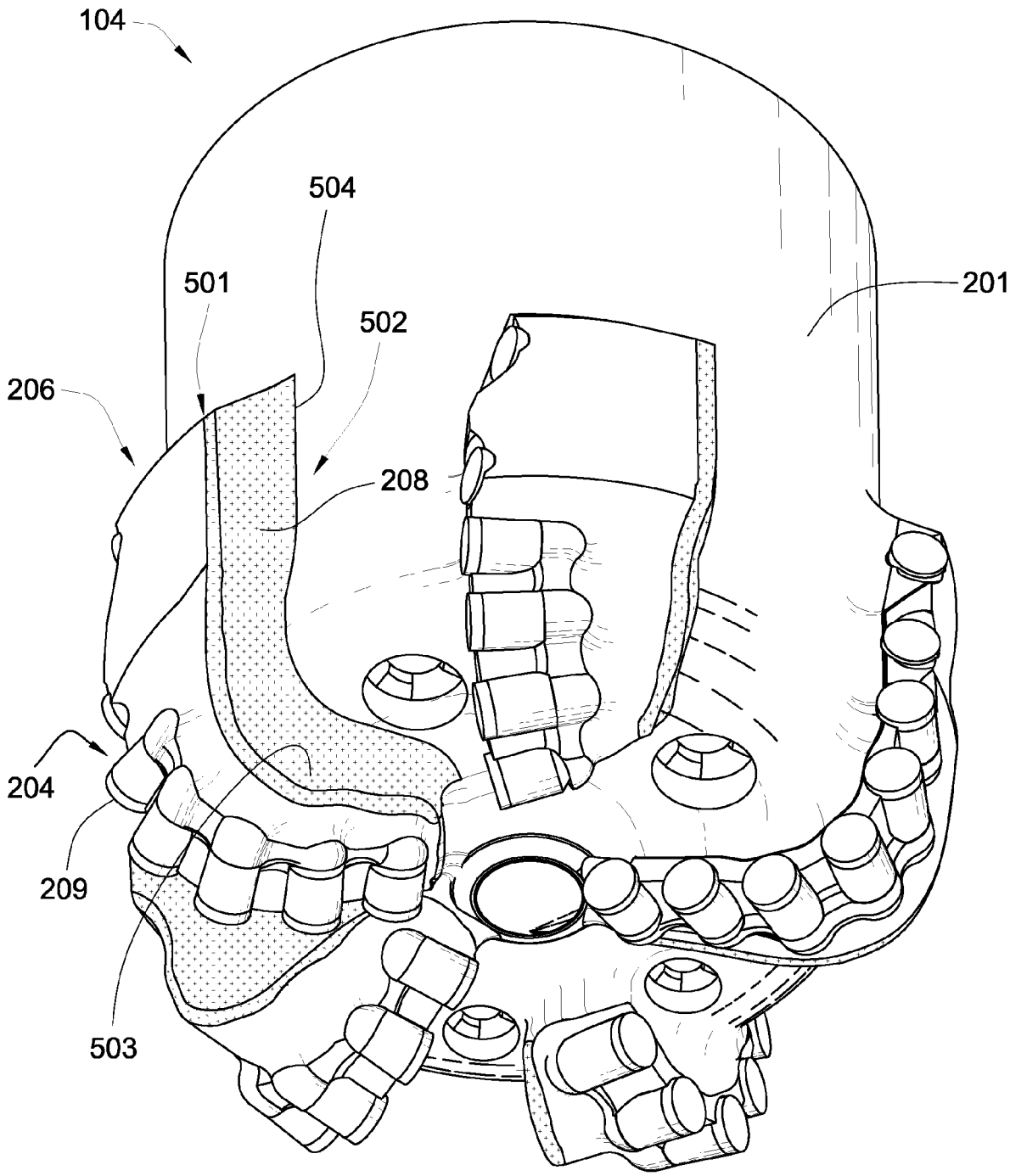
FIG. 5 is a perspective diagram of another embodiment of a drill bit.

Referring now to FIG. 5, the stiffening element 208 may be disposed on a back surface 501 of a blade 206. Back surface 501 may be on an end 502 of the blade 206 that is opposite the cutting surface 209 of at least one cutter element 204. In FIG. 5 a backing plate 503 is shown disposed on the back surface 501. The backing plate 503 may comprise tungsten carbide and may be brazed to the back surface 501. Backing plate 503 may be brazed or press fit into the body 201 of the bit 104 at a base 504 of the blade 206. In some embodiments of the present invention the backing plate 503 may comprise protrusions (not shown) that extend into the blade 206 or the body 201. Brackets (not shown) may also be disposed adjacent the blade base 504 and may stiffen the blade 206.

Figure 6:
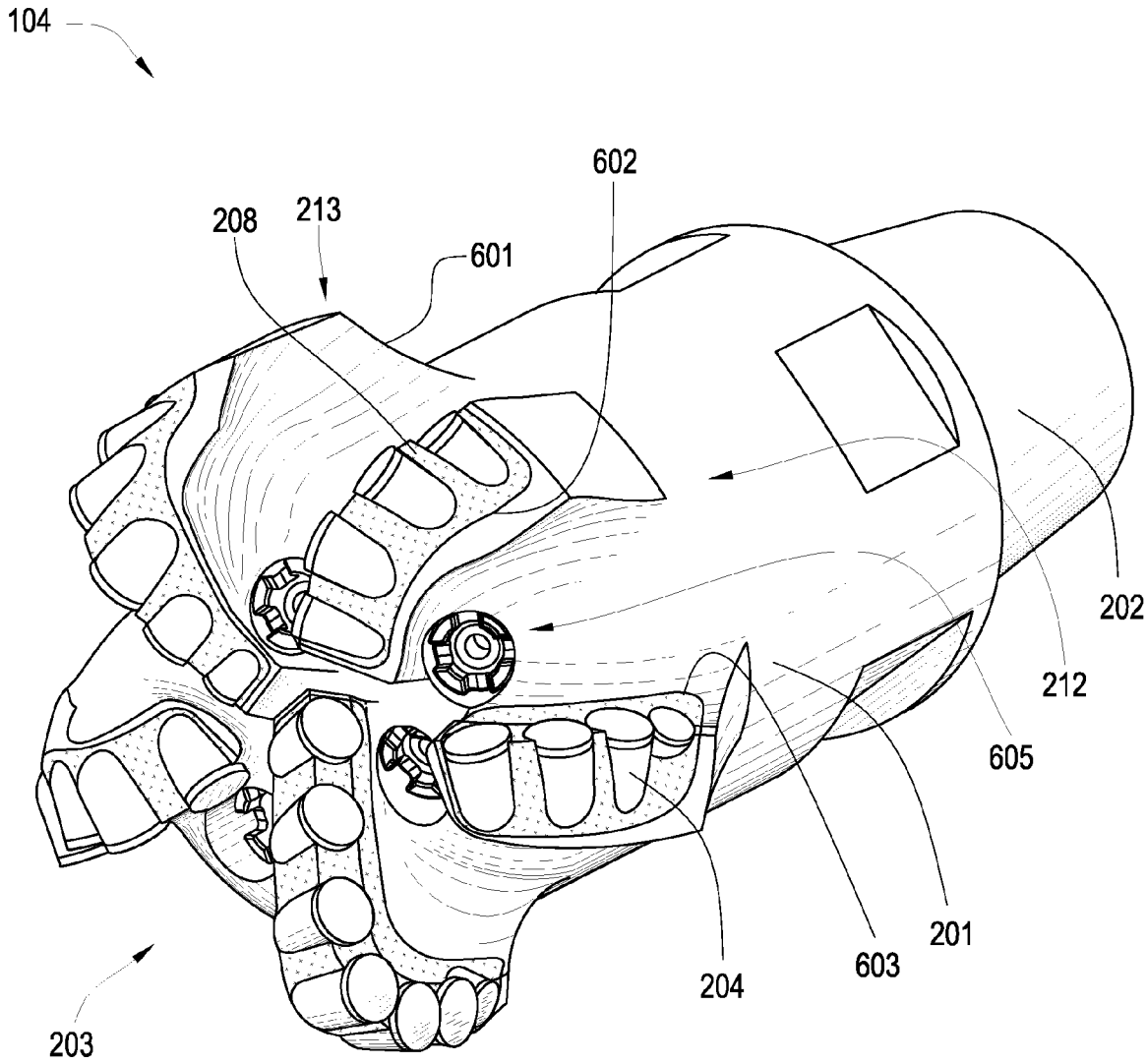
FIG. 6 is a perspective diagram of another embodiment of a drill bit.

FIG. 6 discloses a bit 104 with steel blades 601 that each comprise a recess 602. A stiffening element 208 is disposed within the recess 602 and is attached to the blade 206. The stiffening element 208 may comprise tungsten carbide. It may be brazed to the blade 206 at a non-planar interface 603. A plurality of cutter elements 204 may be attached to the blade 206 by the stiffening element 208. The cutter elements 204 may be brazed to the stiffening element 208. In the embodiment of FIG. 6 the stiffening element 208 is disposed intermediate the cutter elements 204 and the blade 206.

In order to clear the cuttings away from the cutter elements 204 and working face 203, a plurality of high pressure jets 605 is disposed within the junk slots 212 in the working face 203. A jet 605 may be proximate each blade 206. The jets 605 may be connected to a bore of the drill bit 104 through fluid pathways formed in the bit body. The jets 605 may comprise replaceable nozzles disposed within the working face 203. Fluid may pass through the fluid pathways from the bore and be emitted from the jets 605 at a high velocity. The high velocity fluid may then pass through the junk slots 212 in the working face 203 and gauge 213 of the bit 104 and clear the cuttings away from the working face 203.

Figure 7:
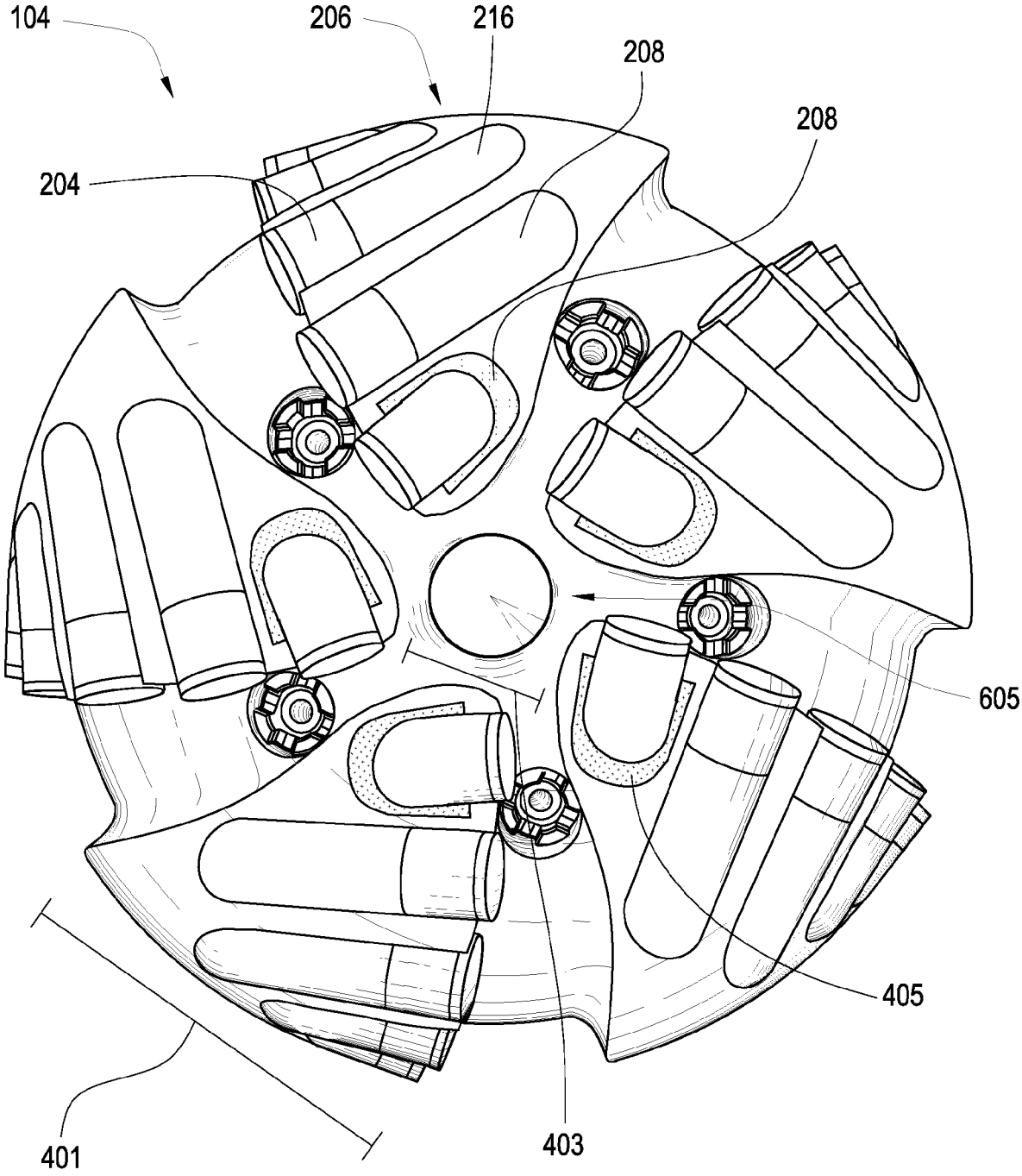
FIG. 7 is an orthogonal diagram of a working face of drill bit.

Referring now to FIG. 7, an embodiment of the invention is disclosed in which two different types of stiffening elements 208 are employed in a single blade 206. Each blade 206 of FIG. 7 comprises a plurality of carbide segments 216 that are brazed to both the blade 206 and to a cutter element 204. The embodiment of FIG. 7 also discloses a blade 206 that is narrower at the nose portion 403 than at the gauge portion 401, hence a shorter carbide segment 216 may be incorporated near the nose portion 403 of the blade 206. A carbide insert 405 may be press fit into the blade 206 on the nose portion 403. A cutter element 204 may then be brazed to the insert 405. The use of multiple types of stiffening elements 208 on a single blade 206 may allow for maximal stiffening of blades 206 despite difficulties posed by various blade geometries.

Figure 8:
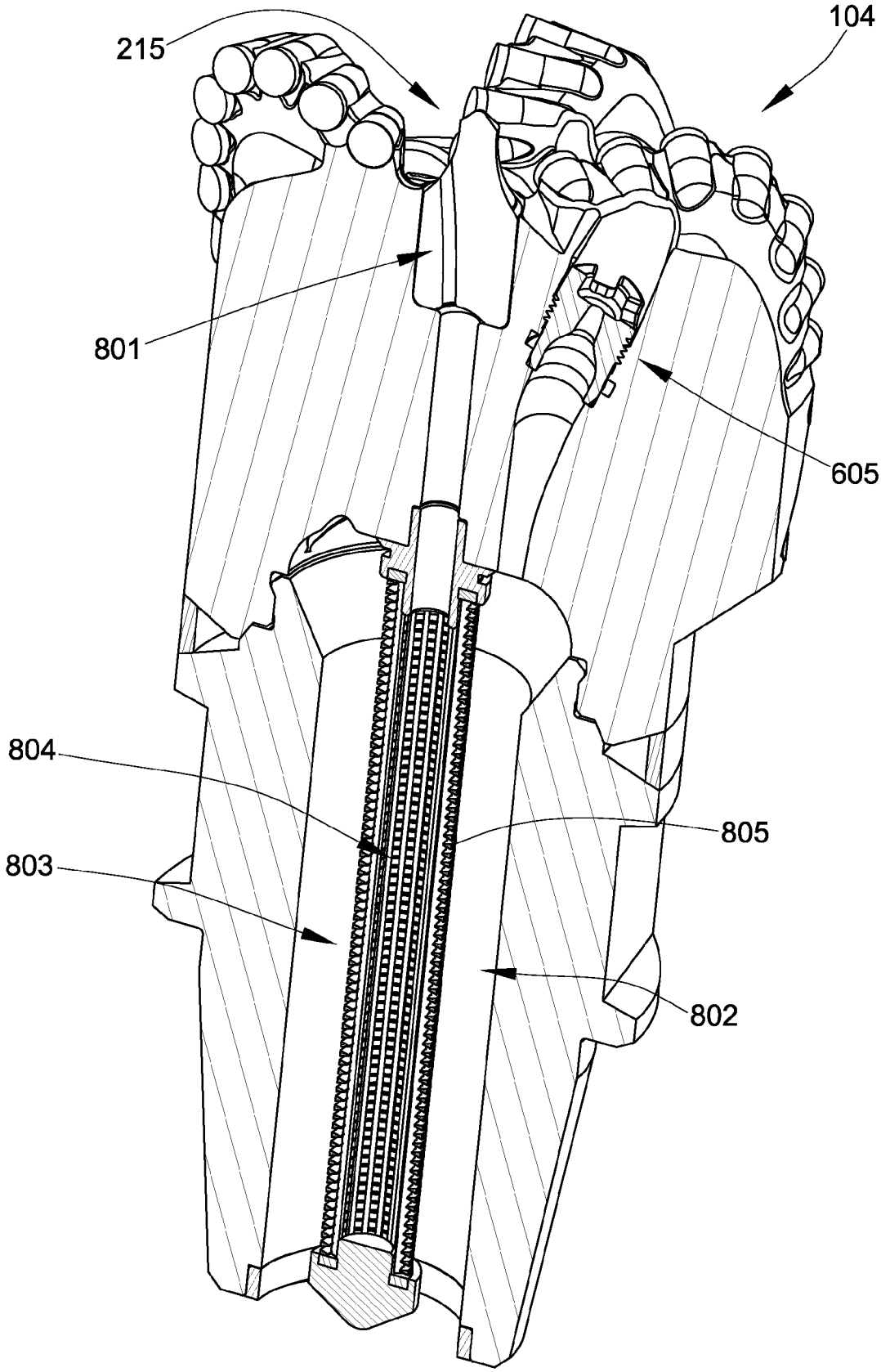
FIG. 8 is a perspective cross-sectional diagram of a drill bit.

Referring now to FIG. 8, a perspective cross-sectional diagram discloses a drill bit 104 comprising a channel 801 disposed within a jack element 215. The drill bit 104 may comprise a plurality of channels 801. Channel 801 and nozzle 605 may both be in fluid communication with a central bore 802 of the tool string 100. Drilling mud (not shown) may be pumped downhole from the surface through the central bore 802. When the mud reaches the bit 104 much of the mud may pass through nozzles 605. Small particles of the mud may pass through a filter wall 803 to its inner region 804 and then through one or more channels 801 formed in the jack element 215, thus preventing large particles from clogging the channels. It is commonly believed that extruding drilling mud as closely as possible to the jack element 215 may increase the efficiency of the drill bit 104 by quickly clearing away drilling debris.

Figure 9:
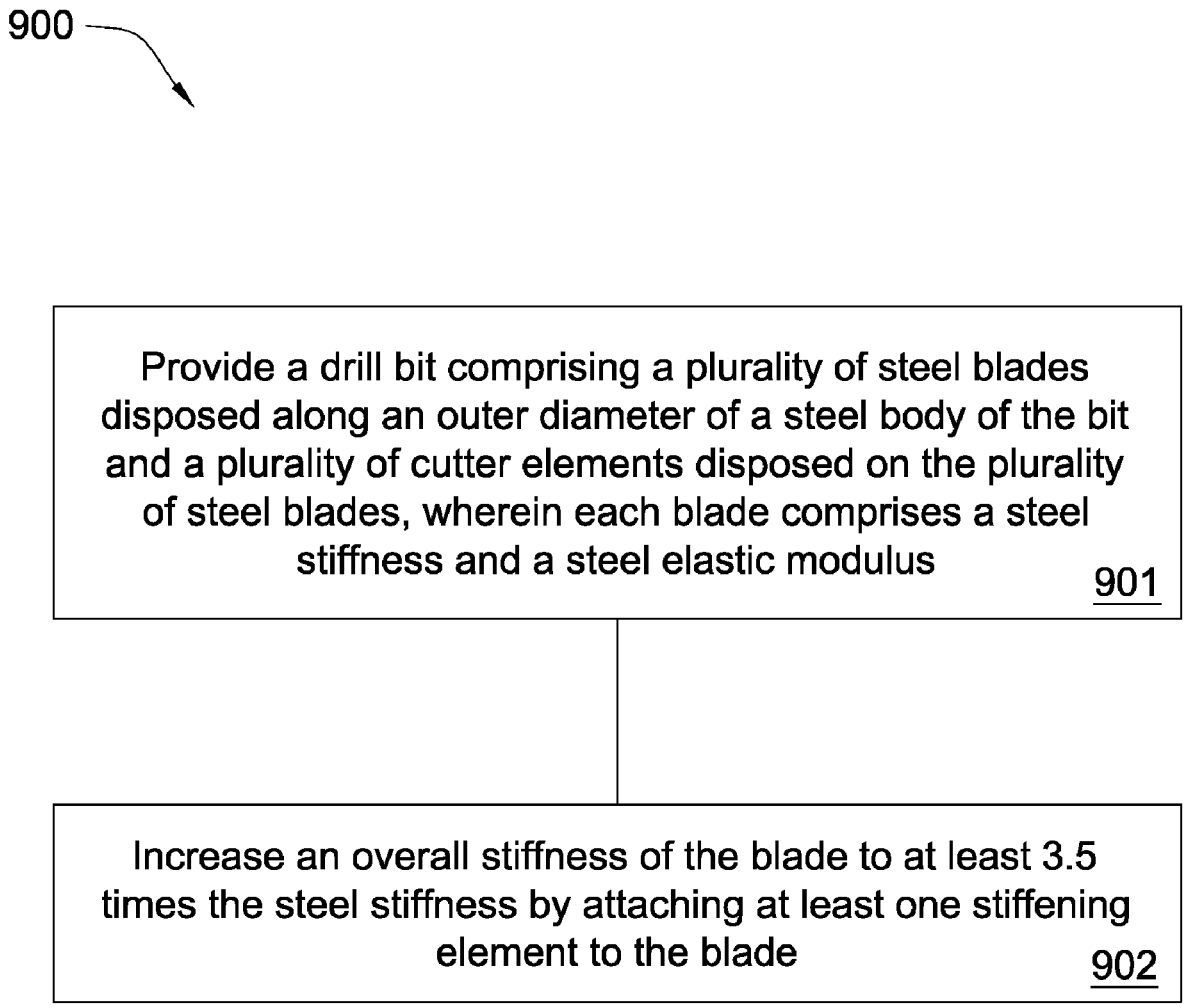
FIG. 9 is a flowchart illustrating a method of stiffening a drill bit.

FIG. 9 discloses a method 900 of stiffening a steel blade 206 on a drill bit 104. The method 900 comprises a step 901 of providing a drill bit 104 comprising a plurality of steel blades 206 disposed along an outer diameter 207 of a steel body 201 of the bit 104 and a plurality of cutter elements 204 disposed on the plurality of steel blades 206, wherein each of the plurality of steel blades 206 comprise a steel stiffness and a steel elastic modulus. The method 900 further comprises a step of increasing an overall stiffness of the blade 206 to at least 3.5 times the steel stiffness by attaching at least one stiffening element 208 to the blade 206.

Whereas the present invention has been described in particular relation to the drawings attached hereto, it should be understood that other and further modifications apart from those shown or suggested herein, may be made within the scope and spirit of the present invention.

What is claimed is:

1. A drill bit, comprising:

a steel body disposed intermediate a threaded end and a working face;

the steel body comprising a plurality of steel blades disposed along an outer diameter of the body and extending radially away from an axis of rotation of the bit;

a plurality of cutter elements disposed on the plurality of steel blades;

the cutting elements each comprising a sintered body of diamond bonded to a cemented metal carbide substrate at a non-planar interface;

the plurality of steel blades each comprising a steel stiffness and a steel elastic modulus;

at least one of the plurality of steel blades comprising a plurality of substantially cylindrical, carbide segments brazed behind and substantially coaxial with the plurality of cutter elements and being brazed to the substrate of the cutting elements; and carbide backing plates are brazed to the back surface of the blade that forms part of the junk slot;

wherein the segments and backing plate together increase the stiffness of the blade by at least 3.5 times the steel stiffness.

2. The drill bit of claim 1, wherein the carbide segment is disposed on a gauge portion of the at least one blade.

3. The drill bit of claim 1, wherein the carbide segment is disposed on a flank portion of the at least one blade.

4. The drill bit of claim 1, wherein the carbide segment is disposed on a nose portion of the at least one blade.

5. The drill bit of claim 1, wherein the carbide segment is disposed on a cone portion of the at least one blade.

6. The drill bit of claim 1, wherein a plurality of generally cylindrical metal carbide segments is disposed along substantially an entire length of the at least one blade.

7. The drill bit of claim 1, wherein at least one of the cutter elements is attached to the at least one blade by the carbide segment.

8. The drill bit of claim 1, wherein the carbide segment comprises an elastic modulus of at least 100 million pounds per square inch.

9. The drill bit of claim 1, wherein the carbide segments increase the stiffness of the blade by at least 5 times the steel stiffness.

10. The drill bit of claim 1, wherein the steel elastic modulus comprises at least 25 million pounds per square inch.

* * * * *